US010589168B1

(12) United States Patent
Lin et al.

(10) Patent No.: US 10,589,168 B1
(45) Date of Patent: Mar. 17, 2020

(54) FLUID FILM GAME TOY

(71) Applicant: HOLD ENTERPRISE CO., LTD.

(72) Inventors: Shau-Chi Lin, New Taipei (TW); Chia-En Chen, New Taipei (TW)

(73) Assignee: HOLD ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 16/125,732

(22) Filed: Sep. 9, 2018

(51) Int. Cl.
*A63F 7/04* (2006.01)

(52) U.S. Cl.
CPC ..... *A63F 7/045* (2013.01); *A63F 7/041* (2013.01); *A63F 2250/0492* (2013.01)

(58) Field of Classification Search
CPC ..... A63H 33/28
See application file for complete search history.

(56) References Cited

U.S. PATENT DOCUMENTS

| | | | | | |
|---|---|---|---|---|---|
| 2,720,723 | A * | 10/1955 | Peretti | A63H 33/28 | 446/15 |
| 3,818,627 | A * | 6/1974 | Lebensfeld | A63H 33/28 | 446/15 |
| 5,035,665 | A * | 7/1991 | Sheng | A63H 33/28 | 446/15 |
| 5,419,728 | A * | 5/1995 | Dallara | A63H 33/28 | 446/15 |
| D428,067 | S * | 7/2000 | Kort | D21/401 | |
| 6,443,790 | B1 * | 9/2002 | Cameron | A63H 33/28 | 446/15 |
| 7,326,099 | B2 * | 2/2008 | Tobias | A63H 33/28 | 446/15 |
| 2014/0273709 | A1 * | 9/2014 | Cripe | A63H 33/28 | 446/16 |

* cited by examiner

*Primary Examiner* — Eugene L Kim
*Assistant Examiner* — Christopher Glenn

(57) ABSTRACT

A fluid film game toy includes a racket including an open frame, a handle connected to the outer perimeter of the open frame and a film-forming face located on the inner perimeter of the open frame for creating a fluid film within the open frame, and a game component to be placed on the fluid film and moved on the fluid film by the player who manipulates the handle to move and/or tilt the open frame.

5 Claims, 7 Drawing Sheets

FLUID FILM GAME TOY

BACKGROUND OF THE INVENTION

1. Field of the Invention

The present invention relates to game toy technology and more particularly, to a fluid film game toy that uses a fluid to create a fluid film within an open frame of a racket for enabling a game component to be moved on the fluid film.

2. Description of the Related Art

Generally, the ice ball game or the maze game is to move the ball on the board. The game mode is quite fixed, and the user loses freshness after using it several times. Therefore, how to create a game device that is different from the existing game mode is a topic that the relevant industry is eager to develop.

SUMMARY OF THE INVENTION

The present invention has been accomplished under the circumstances in view. It is therefore the main object of the present invention to provide a fluid film game toy, which uses a fluid to create a fluid film within an open frame of a racket for enabling a game component to be moved on the fluid film, improving user interest.

To achieve this and other objects of the present invention, a fluid film game toy comprises a racket and a game component. The racket comprises an open frame defining an inner perimeter and an opposing outer perimeter, a handle connected to the outer perimeter of the open frame, a film-forming face located on the inner perimeter of the open frame, and a plurality of stop rods downwardly extended from a bottom wall of the open frame and equiangularly spaced around the film-forming face. The game component has a flat round shape. When playing the game, dip the open frame of the racket in a fluid, and then lift the open frame from the fluid for enabling the fluid to form a fluid film on the film-forming face within the open frame, and then place the game component on the fluid film, and then manipulate the handle to move and/or tilt the open frame, causing the game component to move on the fluid film where the stop rods prohibit the game component from sliding out of the open frame.

Preferably, the racket further comprises a plurality of partition members arranged within the open frame, a fluid film connection face located on a top side of each partition member in a coplanar relationship with the film-forming face, and a plurality of auxiliary stop rods downwardly extended from an opposing bottom side of each partition member.

Preferably, the racket further comprises a plurality of connection members connecting the partition members to the open frame.

DETAILED DESCRIPTION OF THE PREFERRED EMBODIMENT

Figure 1:
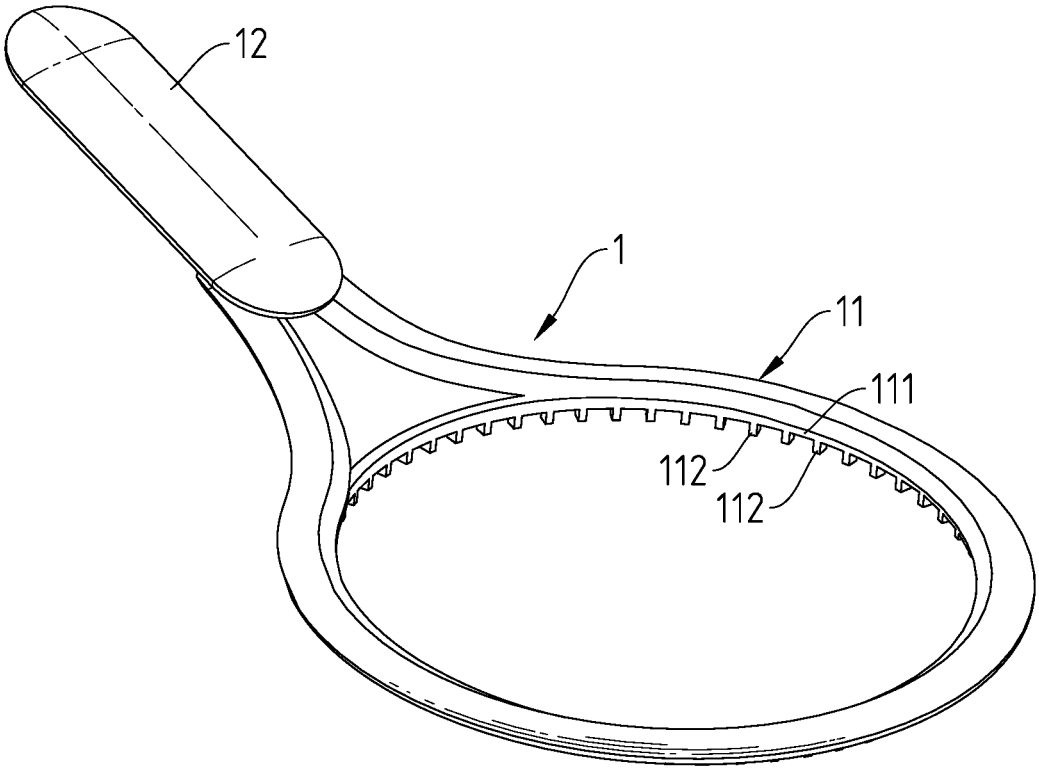
FIG. 1 is an oblique top elevational view of a racket for fluid film game toy in accordance with a first embodiment of the present invention.
Figure 2:
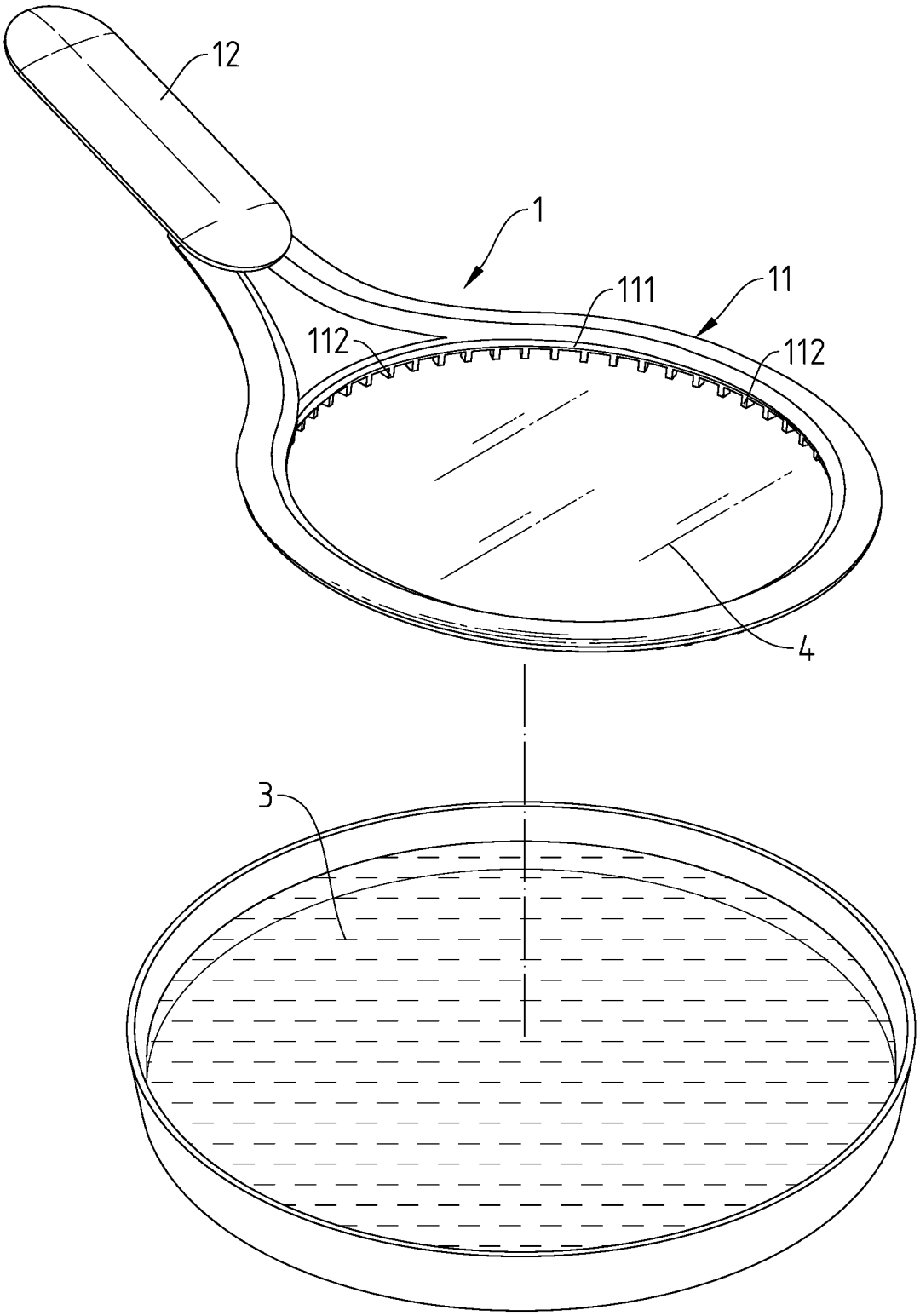
FIG. 2 is a schematic applied view of the first embodiment of the present invention, illustrating a fluid film formed within the open frame
Figure 3:
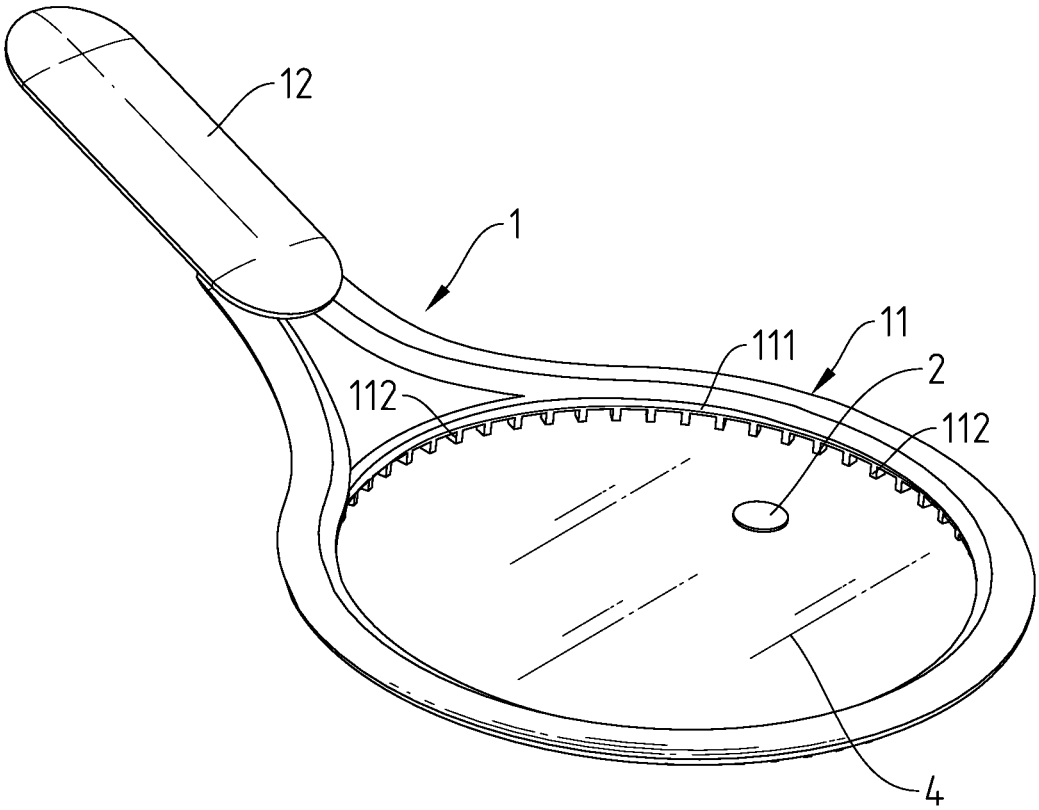
FIG. 3 is a schematic applied view of the first embodiment of the present invention, illustrating the game component placed on the fluid film within the open frame.
Figure 4:
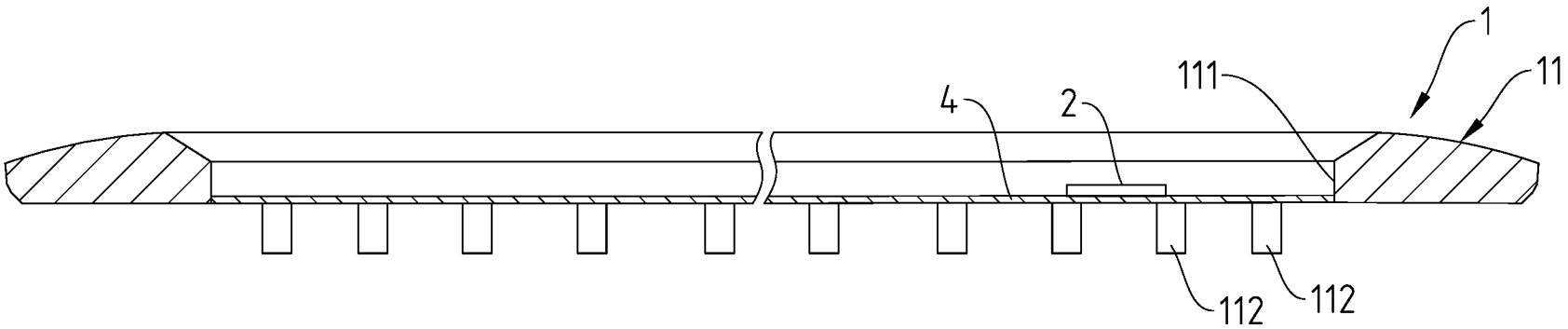
FIG. 4 is a cross-sectional view of the first embodiment of the present invention, illustrating the game component placed on the fluid film within the open frame.

Referring to FIGS. 1-4, a fluid film game toy in accordance with a first embodiment of the present invention is shown. The fluid film game toy comprises a racket 1 and a game component 2. The racket 1 comprises an open frame 11, a handle 12 connected to an outer perimeter of the open frame 11, a film-forming face 111 located on an opposing inner perimeter of the open frame 11, and a plurality of stop rods 112 downwardly extended from a bottom wall of the open frame 11 and equiangularly spaced around the film-forming face 111. The game component 2 has a flat round shape. When playing the game, as shown in FIG. 2, hold the handle 12 to dip the open frame 11 in a fluid 3 for few seconds, then lift the open frame 11 from the fluid 3, causing the fluid 3 to form a fluid film 4 within the film-forming face 111. Thereafter, as shown in FIG. 3 and FIG. 4, place the game component 2 on the surface of the fluid film 4, and manipulate the handle 12 to move and/or tilt the open frame 11, causing the game component 2 to move on the fluid film 4. Since the game component 2 has a certain weight, it will force the fluid film 4 to sink to a bottom side of the film-forming face 111. Thus, when game component 2 approaches the film-forming face 111, it can slide out of the open frame 11 through the border edge of the film-forming face 111. Subject to the arrangement of the stop rods 112, the game component 2 is prohibited from sliding out of the open frame 11.

Figure 5:
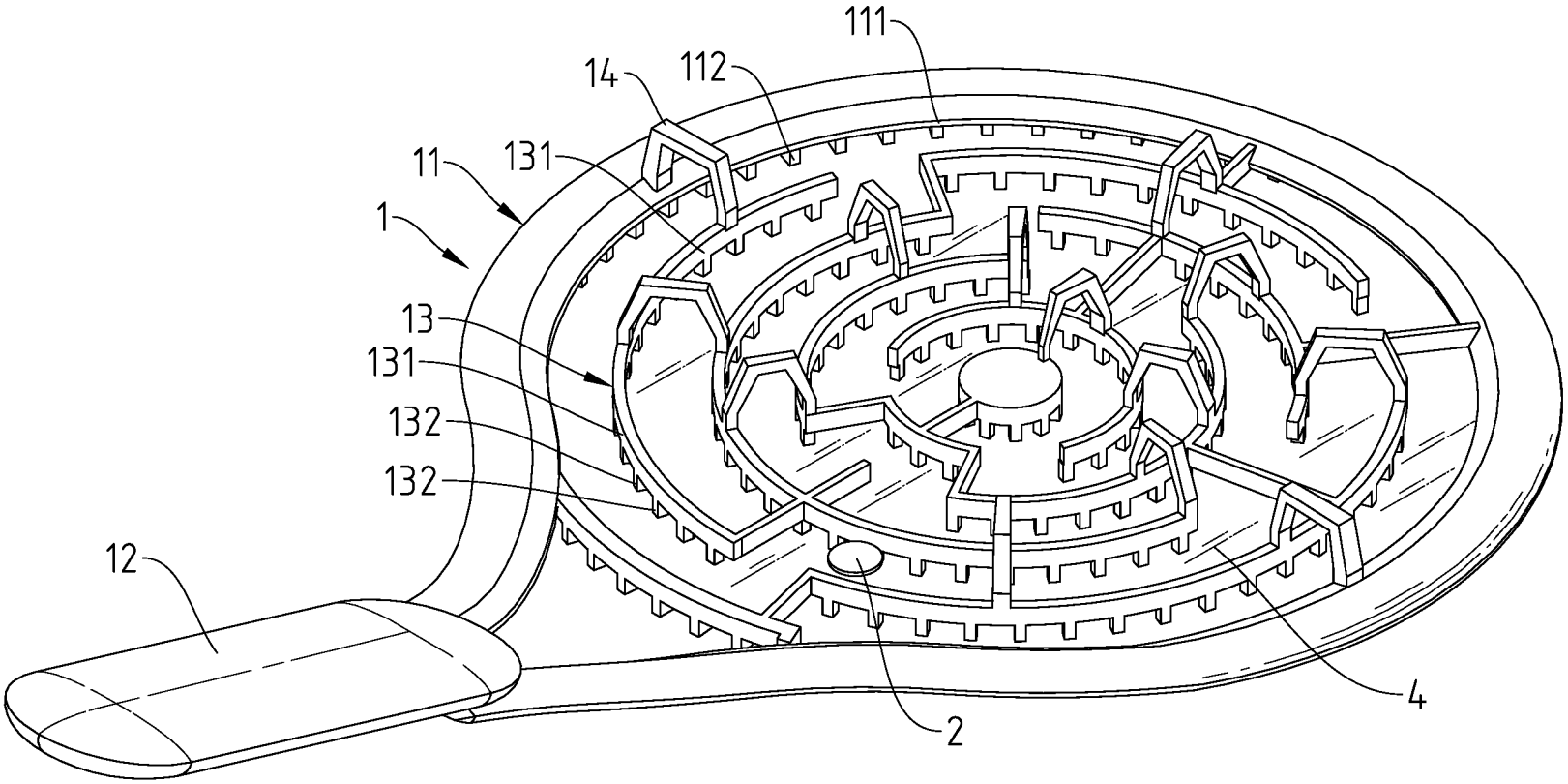
FIG. 5 is an oblique top elevational view of a fluid film game toy in accordance with a second embodiment of the present invention.

FIG. 5 illustrates a fluid film game toy in accordance with a second embodiment. This second embodiment is substantially similar to the aforesaid first embodiment with the exception that the racket 1 further comprises a plurality of partition members 13 arranged within the open frame 11, a plurality of connection members 14 connecting the partition members 13 to the open frame 11, a fluid film connection face 131 located on a top side of each partition member 13 in a coplanar relationship with the film-forming face 111, and a plurality of auxiliary stop rods 132 downwardly extended from an opposing bottom side of each partition member 13. When playing the game, the fluid 3 can form a fluid film 4 on the film-forming face 111 and the fluid film connection faces 131 of each partition member 13 within the open frame 11. When the user plays the game, the partition members 13 define a maze of narrow roads on the fluid film 4 through which the game component 2 is controlled to move on the fluid film 4.

Figure 6:
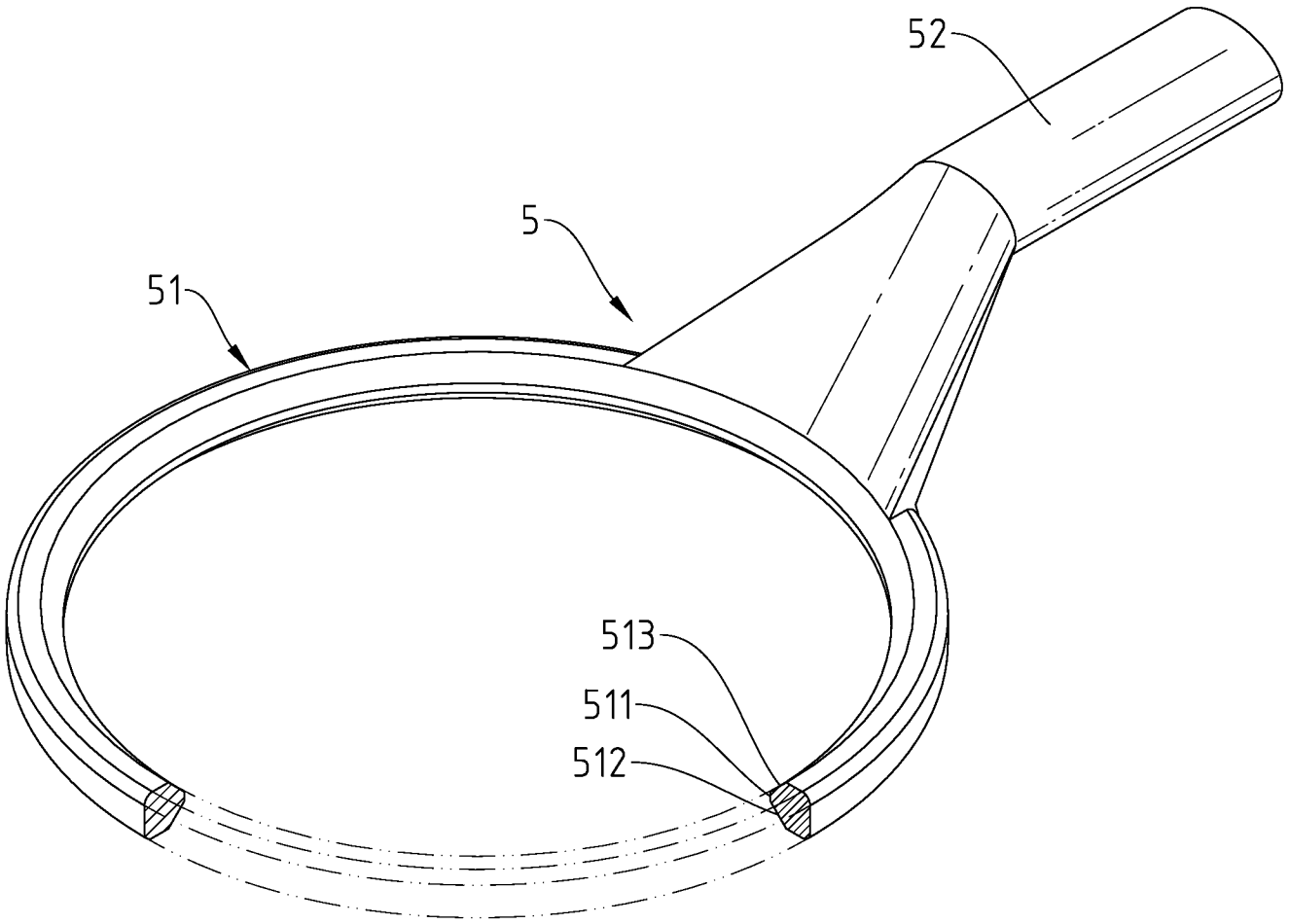
FIG. 6 is a sectional elevation of a racket for fluid film game toy in accordance with a third embodiment of the present invention.
Figure 7:
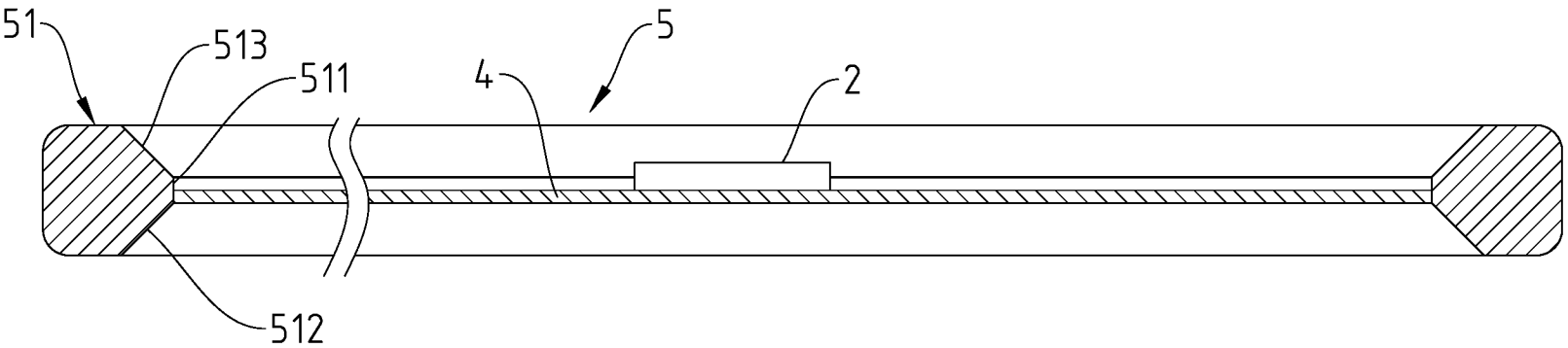
FIG. 7 is a cross-sectional view of the fluid film fame toy in accordance with a third embodiment of the present invention.

FIGS. 6 and 7 illustrate a fluid film game toy in accordance with a third embodiment. According to this third embodiment, the racket 5 comprises an open frame 51, a handle 52 connected to an outer perimeter of the open frame

51, a film-forming face 511 located on an opposing inner perimeter of the open frame 51, a beveled stop face 512 located on the inner perimeter of the open frame 51 at a bottom side of the film-forming face 511, and a beveled guide face 513 located on the inner perimeter of the open frame 51 at an opposing top side of the film-forming face 511. When playing the game, hold the handle 52 to dip the open frame 51 in a fluid 3 for few seconds, then lift the open frame 51 from the fluid 3, causing the fluid 3 to move from the beveled guide face 513 toward the film-forming face 511 and then to form a fluid film 4 within the film-forming face 511. Thereafter, place the game component 2 on the surface of the fluid film 4, and manipulate the handle 52 to move and/or tilt the open frame 51, causing the game component 2 to move on the fluid film 4. When game component 2 approaches the film-forming face 511, the arrangement of the beveled stop face 512 prohibits the game component 2 from sliding out of the open frame 51.

What the invention claimed is:

1. A fluid film game toy, comprising:

a racket comprising an open frame defining an inner perimeter and an opposing outer perimeter, a handle connected to the outer perimeter of said open frame, a film-forming face located on the inner perimeter of said open frame, and a plurality of stop rods downwardly extended from a bottom wall of said open frame and equiangularly spaced around said film-forming face; and a game component in a flat round shape;

wherein when playing the game, dip said open frame of said racket in a fluid, and then lift said open frame from said fluid for enabling said fluid to form a fluid film on said film-forming face within said open frame, and then place said game component on said fluid film and then manipulate said handle to move and/or tilt said open frame, causing said game component to move on said fluid film where said stop rods prohibit said game component from sliding out of said open frame.

2. The fluid film game toy as claimed in claim 1, wherein said racket further comprises a plurality of partition members arranged within said open frame, a fluid film connection face located on a top side of each said partition member in a coplanar relationship with said film-forming face, and a plurality of auxiliary stop rods downwardly extended from an opposing bottom side of each said partition member.

3. The fluid film game toy as claimed in claim 2, wherein said racket further comprises a plurality of connection members connecting said partition members to said open frame.

4. A fluid film game toy, comprising:

a racket comprising an open frame defining an inner perimeter and an opposing outer perimeter, a handle connected to the outer perimeter of said open frame, a film-forming face located on the inner perimeter of said open frame, and a beveled stop face located on the inner perimeter of said open frame at a bottom side of said film-forming face; and a game component in a flat round shape;

wherein when playing the game, dip said open frame of said racket in a fluid, and then lift said open frame from said fluid for enabling said fluid to form a fluid film on said film-forming face within said open frame, and then place said game component on said fluid film and then manipulate said handle to move and/or tilt said open frame, causing said game component to move on said fluid film where said beveled stop face prohibits said game component from sliding out of said open frame.

5. The fluid film game toy as claimed in claim 4, wherein said racket further comprises a beveled guide face located on the inner perimeter of said open frame at an opposing top side of said film-forming face.

* * * * *